US006272946B1

(12) United States Patent
Roux

(10) Patent No.: US 6,272,946 B1
(45) Date of Patent: Aug. 14, 2001

(54) STEERING DEVICE FOR MINIATURE VEHICLE

(76) Inventor: Philippe Roux, La Grange Neuve, F-39210 Frontenay (FR)

( * ) Notice: Subject to any disclaimer, the term of this patent is extended or adjusted under 35 U.S.C. 154(b) by 0 days.

(21) Appl. No.: 09/402,871

(22) PCT Filed: Apr. 7, 1998

(86) PCT No.: PCT/FR98/00707

§ 371 Date: Dec. 13, 1999

§ 102(e) Date: Dec. 13, 1999

(87) PCT Pub. No.: WO98/45008

PCT Pub. Date: Oct. 15, 1998

(30) Foreign Application Priority Data

Aug. 4, 1997 (FR) ..... 97 04520

(51) Int. Cl.[7] ..... B62D 3/02; B62D 3/12; A63H 17/38

(52) U.S. Cl. ..... 74/498; 446/451; 446/468; 464/30; 464/39

(58) Field of Search ..... 74/498; 446/451, 446/454, 468; 464/30, 39; 280/93.513, 93.514

(56) References Cited

U.S. PATENT DOCUMENTS

| | | | | |
|---|---|---|---|---|
| 1,911,507 | * | 5/1933 | Hitchcock | 464/39 |
| 4,248,012 | * | 2/1981 | Kirby et al. | 446/460 |
| 4,267,663 | * | 5/1981 | Nagahara | 446/440 |
| 4,387,532 | * | 6/1983 | Suimon | 446/440 |
| 4,595,380 | * | 6/1986 | Magers | 446/451 |
| 5,240,451 | | 8/1993 | Clark, Jr. | 446/431 |
| 5,281,184 | * | 1/1994 | Suimon | 446/460 |

FOREIGN PATENT DOCUMENTS

| | | |
|---|---|---|
| WO 91/07217 | 5/1991 | (AU) . |
| 2299765 | 10/1996 | (GB) . |

* cited by examiner

*Primary Examiner*—Allan D. Herrmann
(74) *Attorney, Agent, or Firm*—Nilles & Nilles SC

(57) ABSTRACT

A steering device for moving and directing a miniature vehicle provided with at least one leading wheel, the steering device has a control member arranged outside the miniature vehicle to be remote-manipulated by the user, a transmission for transmitting inside the miniature vehicle any movement produced on the control member, and a support component for deflecting each leading wheel controlled by the transmission. The steering device has converting members for gearing down any primary movement actuating the transmission into a secondary movement for deflecting each leading wheel. The steering device is applicable to toys, in particular miniature vehicles remote-controlled by a control member with dimensions and positioning corresponding to the child's morphology.

22 Claims, 6 Drawing Sheets

STEERING DEVICE FOR MINIATURE VEHICLE

BACKGROUND OF THE INVENTION

1. Field of the Invention

The present invention relates to a driving device for moving and steering a miniature vehicle provided with at least one steered wheel.

2. Description of the Related Art

The invention is particularly advantageously applicable in the field of toys, and especially in the field of miniature vehicles remote-controlled by a control member whose dimensions and positioning correspond to the child's morphology; the child must be able to move and steer such a vehicle with the aid of the driving device while walking upright.

The majority of driving devices known from the prior art comprise archaic and generally rudimentary mechanisms. In the majority of cases, the orientation of the steered wheels is provided by mere pivoting of the axle on which said wheels are freely mounted. This movement, controlled by the rotation of the control member, is transmitted by the agency of transmission means generally taking the form of a more or less articulated steering column acting directly on the steering axle. It will readily be understood that this type of device is entirely incapable of simulating real driving or the behavior of a real vehicle, which considerably restricts the attraction of such a toy.

Efforts have been made to remedy these problems by providing the miniature vehicle with real steered wheels, that is to say wheels that can be oriented along different axes. In a known manner, each of them is mounted free to rotate on pivoting support means. The latter are, for their part, actuated individually by steering tie rods connected to a rudder bar which is itself interdependent with the steering column.

Although this type of embodiment proves superior in terms of enjoyment to that described previously, the fact remains that it is still insufficiently realistic to be able to communicate to its user genuine sensations of driving such as to give the toy a lasting interest.

OBJECTS AND SUMMARY OF THE INVENTION

Thus, the technical object to be achieved by the subject-matter of the present invention is that of providing a driving device for moving and steering a miniature vehicle provided with at least one steered wheel, said driving device comprising a control member, arranged outside the miniature vehicle, to be remote-manipulated by the user, transmission means transferring inside said miniature vehicle any movement produced on the control member, and means for deflecting each steered wheel which are controlled by said transmission means; which driving device would make it possible to avoid the problems of the prior art by providing an even more striking analogy between the behavior of the toy and that of a genuine vehicle, that is to say a device capable of realistically simulating the principal sensations derived from driving a genuine vehicle.

The solution to the stated technical problem resides, according to the present invention, in the fact that said driving device comprises conversion means for gearing down any primary movement actuating the transmission means into a secondary movement transmissible to the means for deflecting each steered wheel.

The invention as defined possesses the advantage of offering very great driving precision, precisely because of the phenomenon of gearing-down created by the conversion means, which reduces in a predetermined fashion the speed and extent of the primary movement actuating the transmission means. The secondary movement resulting from this conversion is thus adapted to the general configuration of the deflection means.

Consequently, the angular displacement of each steered wheel of the miniature vehicle does not correspond in an identical manner to that of the control member. In this specific case, the steering is not direct, contrary to the driving devices of the prior art, the deflection of each wheel being simply proportional to the angular displacement of the control member.

The sensitivity of the steering, in other words the deflection of the wheels as a function of a given angular displacement of the control member, may advantageously be modulated by varying the gearing-down ratio in order to obtain, as the case may be, extremely precise or substantially more lively driving.

According to a first embodiment of the invention, the conversion means comprise, in particular, two mobile members interacting in meshing, said mobile members being respectively interdependent with the transmission means and the deflection means. This configuration has the advantage of significantly reducing the functional plays and thus reducing wear phenomena to the same extent, while increasing the reliability of the driving device which is the subject of the invention.

According to a first alternative version of the first embodiment of the invention, the mobile member interdependent with the transmission means comprises a pinion, while the mobile member interdependent with the deflection means takes the form of a component forming a rudder bar, mounted to pivot relative to the miniature vehicle and possessing a notched sector capable of interacting by meshing with said pinion. The secondary movement transmissible to the deflection means is in this case a rotary movement.

According to a second alternative version of the first embodiment of the invention, the mobile members interdependent with the transmission means and the deflection means comprise, respectively, a pinion and a rack, that is to say a notched bar. The assembly thus formed is able to transform any rotary movement actuating the transmission means into a linear movement transmissible to the deflection means.

According to a second embodiment of the invention, the conversion means comprise two mobile members interacting to produce driving by adhesion. As in the first case, these mobile members are interdependent with, respectively, the transmission means and the deflection means, but the functional play in this case is eliminated completely, so that the precision of driving is further substantially improved.

In a particularly advantageous manner, at least one of the two mobile members comprises an adhesive coating on the surface intended to come into contact with the associated mobile member. This coating may, of course, be constituted on the basis of any soft and adhesive material, such as for example rubber of an appropriate hardness, but may equally well be any other known material having equivalent mechanical properties.

According to another special feature, at least one of the two mobile members comprises a rough zone on the surface intended to come into contact with the associated mobile member. Here again, this rough zone may be of any conceivable shape. If necessary, it may even be rubberized, for example by overmolding. However, its presence is only fully justified in combination with another rough zone made on the contact surface of the associated mobile member, or with an adhesive coating arranged on said contact surface of the associated mobile member.

According to a first alternative version of the second embodiment of the invention, the mobile member interdependent with the transmission means is constituted by a wheel, while the mobile member interdependent with the deflection means takes the form of a component forming a rudder bar, mounted to pivot relative to the miniature vehicle and having a sector capable of interacting by adhesion with said wheel. The secondary movement transmissible to the deflection means is here a rotary movement.

According to a second alternative version of the second embodiment of the invention, the mobile members interdependent with the transmission means and the deflection means are constituted, respectively, by a wheel and by a rod, which are respectively movable in rotation and in translation. The assembly thus formed is able to convert any rotary movement actuating the transmission means into a linear movement transmissible to the deflection means.

It should be noted that, throughout this description, the term "interdependent with" means that the members in question are dependent upon one another and travel and operate jointly in a common movement, action or process, but are not necessarily in direct contact. Similarly, the term "pinion" may indicate any component comprising at least one part in the form of a portion of a toothed wheel.

According to another feature of the invention, safety means are provided in order to preserve the integrity of the various parts forming the driving device when an excessive torque is applied to the control member and/or to the transmission means.

BRIEF DESCRIPTION OF THE DRAWINGS

The description which follows, with reference to the attached awings, given by way of non-limiting examples, will provide a clear understanding of what the invention comprises and how it can be implemented.

DESCRIPTION OF THE PREFERRED EMBODIMENTS

Figure 1:
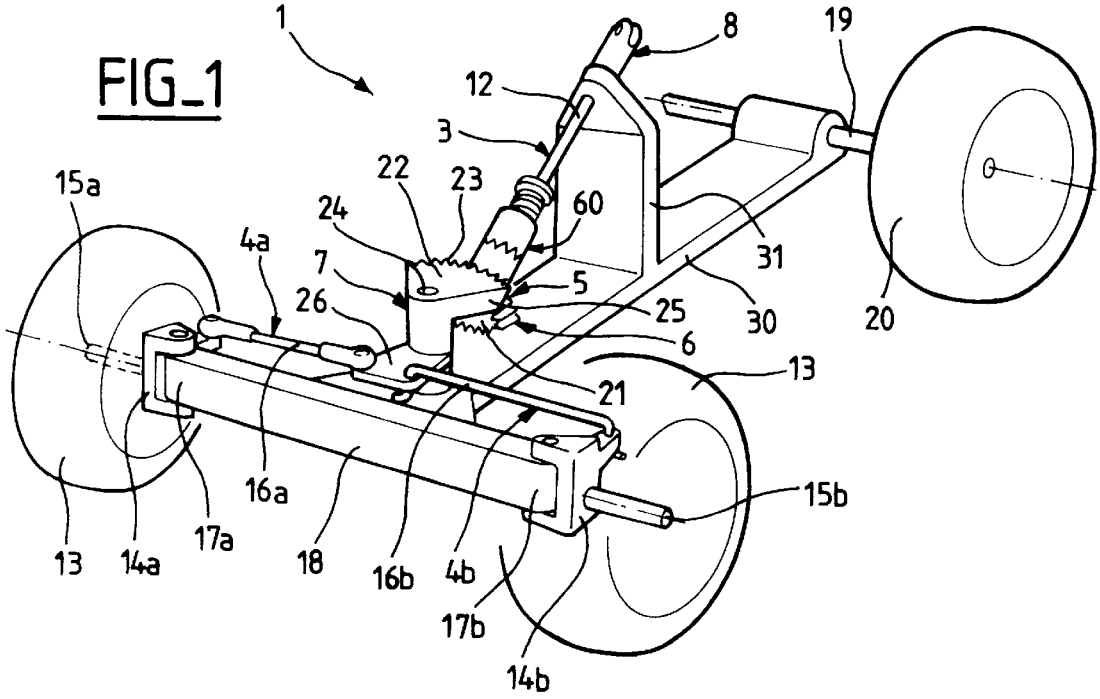
FIG. 1 is a perspective view of a driving device according to a first alternative version of a first embodiment of the invention, that is to say an embodiment wherein the conversion means are constituted by two mobile members interacting by meshing.

For reasons of clarity, the same parts have been designated by identical reference numerals. Similarly, only those parts essential to an understanding of the invention have been shown, diagrammatically and not to scale.

Figure 2:
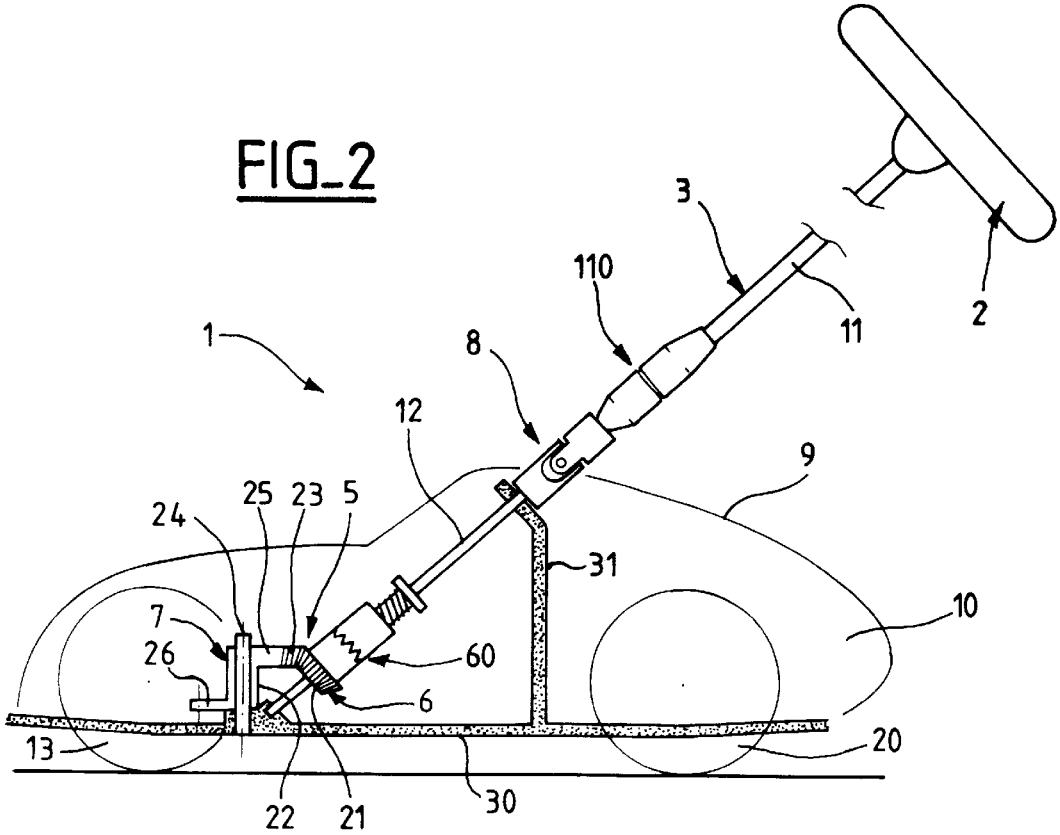
FIG. 2 shows a side view of a miniature vehicle provided with the driving device according to FIG. 1.

As can be seen in FIGS. 1 and 2, the driving device 1 comprises, in particular, a control member 2, in this case in the form of a steering wheel, transmission means 3, deflection means 4*a*, 4*b* and conversion means 5 comprising two mobile members 6, 7 interacting by meshing.

The transmission means 3, which may comprise a simple connecting rod linking the control member 2 to the conversion means 5, advantageously comprise in this case an articulation mechanism 8 forming a cardan joint and positioned in the immediate vicinity of the outer surface 9 of the miniature vehicle 10 (FIG. 2). The transmission means 3 consequently comprise two sections of connecting rods: a main rod 11 joining the control member 2 to one of the ends of the articulation mechanism 8, and a secondary rod 12 which, for its part, joins the other end of said articulation mechanism 8 to the conversion means 5. The secondary rod 12 is, moreover, mounted free to rotate on the chassis 30 via a support lug 31, while the main rod 11 possesses even more freedom of movement since it is able to swing relative to the longitudinal axis of said secondary rod 12.

The presence of the articulation mechanism 8 forming a cardan joint advantageously makes it possible not to lock the control member 2 in a given position but to impart to it great spatial mobility so as to allow it to adapt to the size of its user and/or the relative positioning of said user relative the miniature vehicle 10.

In practice, the main rod 11 and/or the secondary rod 12 are advantageously produced from glass fiber, that is to say a material having mechanical properties which are very different depending on the axis along which said material is stressed. This is because a rod thus formed simultaneously combines a degree of longitudinal flexibility with great torsional strength. Of course, if the miniature vehicle 10 is intended for users who are less demanding in terms of driving comfort, it is possible to use any type of known material, for example an extruded plastic.

The deflection means 4*a*, 4*b* comprise, for each steered wheel 13, first a support component 14*a*, 14*b* on which said steered wheel 13 is mounted free to rotate about an axis 15*a*, 15*b*, and secondly a coupling bar 16*a*, 16*b* intended to link said support component 14*a*, 14*b* to the conversion means 5. In the two examples shown in FIG. 1, the coupling bars 16*a*, 16*b* are formed respectively by a connecting rod with ball joints and a simple rod with bayonet fittings. The first embodiment, in which precision is the highest priority, may advantageously comprise adjustment means taking the form, for example, of a threaded connecting rod with which at least one of the ball joints interacts by screwing; the other embodiment being preferable in the case where the selling price is the highest priority in the design of the toy.

The U-shaped support components 14*a*, 14*b* are, moreover, mounted pivotingly at the ends 17*a*, 17*b* of a transverse girder 18 interdependent with the front part of the chassis 30. The rear part of the latter, for its part, accommodates an axle 19 supporting the rear wheels 20.

In this first alternative version of the first embodiment of the invention, the mobile member 6 interdependent with the transmission means 3 is constituted by a toothed wheel 21 forming a pinion. The member 7 interdependent with the deflection means 4*a*, 4*b*, for its part, is in the form of a component 22 forming a rudder bar, interacting by meshing with the pinion 21 via a toothed circular sector 23. The rudder bar 22 is here mounted vertically to pivot relative to the chassis 30 about an axis 24. It comprises two parts 25, 26 extending orthogonally to its axis of rotation, in different planes and in opposite direction. The toothed circular sector 23 is provided at the end of the upper part 25, its size and orientation being such as to allow interaction by meshing with the pinion 21. The lower part 26, for its part, serves as a fixing point for the connecting bars 16*a*, 16*b*.

Figure 3:
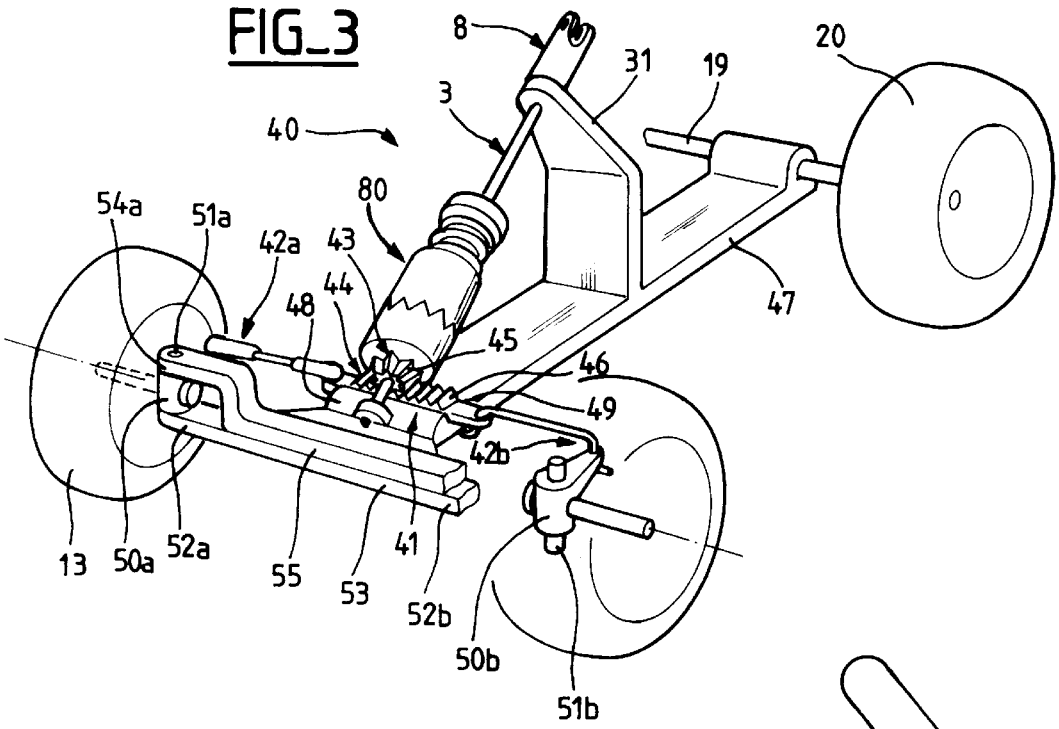
FIG. 3 is a perspective view of a driving device according to a second alternative version of the first embodiment of the invention.
Figure 4:
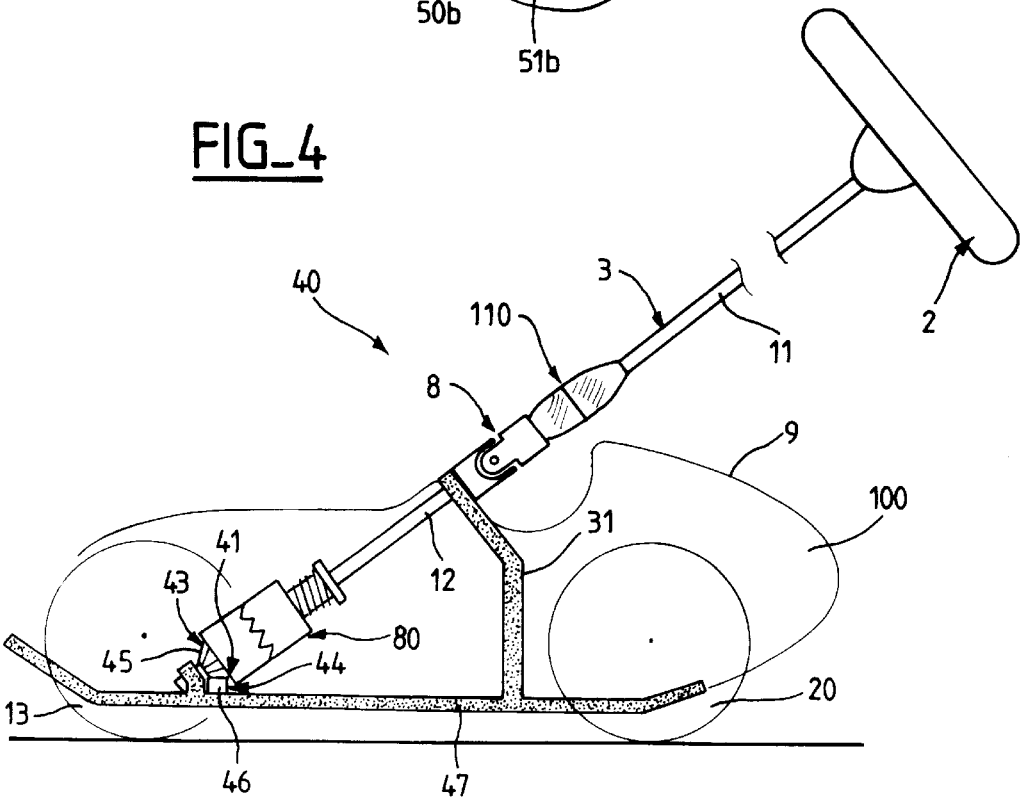
FIG. 4 is a lateral view of a miniature vehicle equipped with the driving device according to FIG. 3.

FIG. 3 shows a driving device 40 according to a second embodiment substantially different from the first, described above, in particular as regards the conversion means 41 and the deflection means 42*a*, 42*b*.

As in the previous case, the conversion means 41 are constituted by two mobile members 43, 44, interacting by meshing. The member 43 interdependent with the transmission means 3 is in the form of a pinion 45 of small diameter, while the member 44 interdependent with the deflection means 42*a*, 42*b* is constituted by a rack 46, that is to say a notched rectilinear rod. The rack 46 is mounted transversely to slide on the chassis 47, between two shoulders 48, 49.

The deflection means 42*a*, 42*b* exhibit, for their part, minimal differences by comparison with their counterparts in FIG. 1. Each support component 50*a*, 50*b*, mounted to pivot about an axis 51*a*, 51*b*, is here sandwiched between, on the one hand, one of the ends 52*a*, 52*b* of a transverse girder 53 interdependent with the front part of the chassis 47 and, on the other hand, the elbowed end 54*a*, 54*b* of a second girder 55 superposed on the first.

Figure 5:
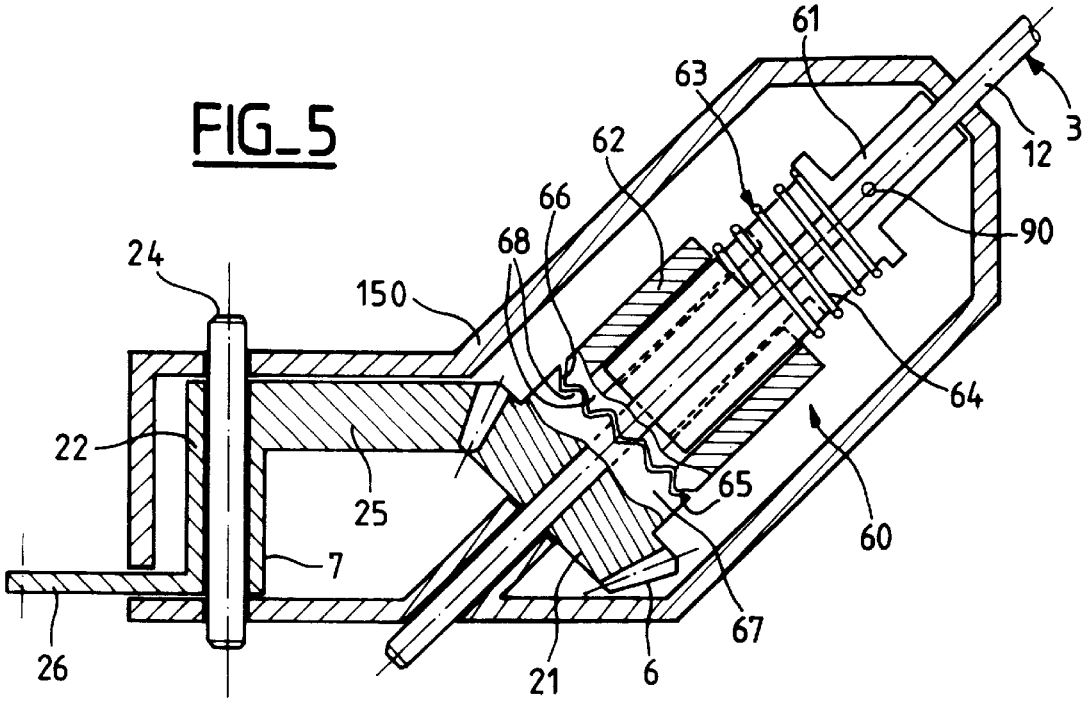
FIG. 5 is a longitudinal section showing safety means according to the invention.
Figure 6:
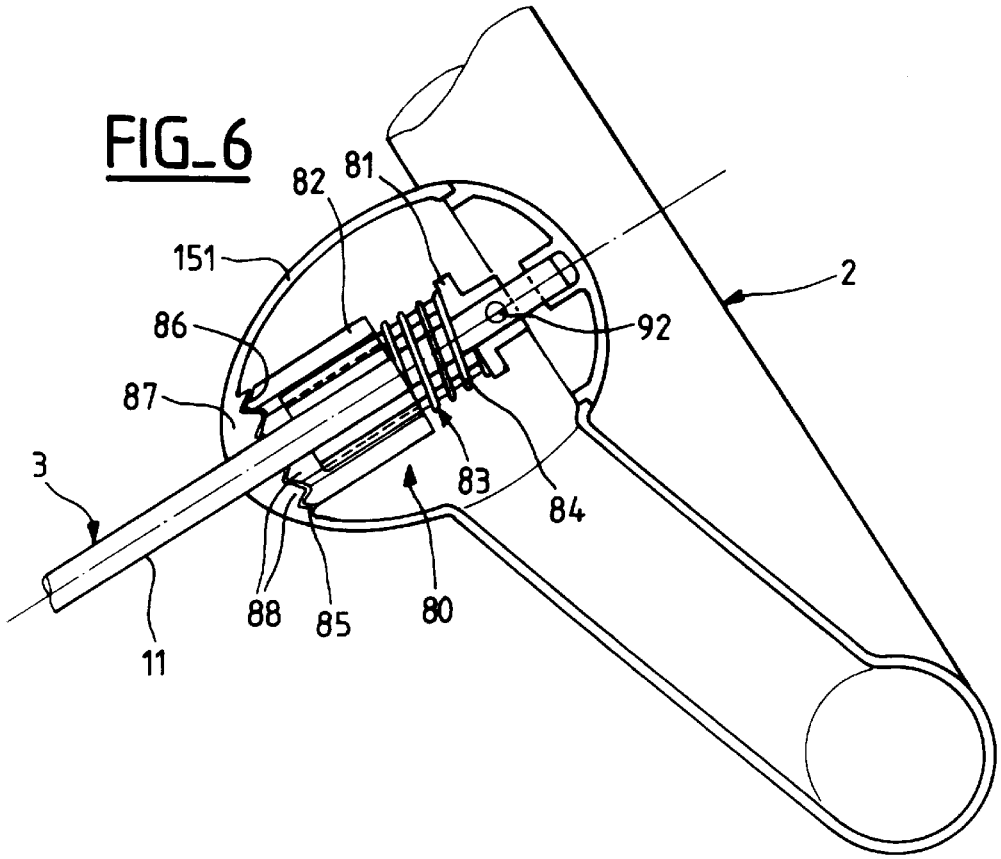
FIG. 6 is an alternative version of an embodiment of the safety means according to FIG. 5.

In FIGS. 5 and 6, two alternative embodiments may be seen relating to safety means 60, 80 which are partially visible in FIGS. 1 and 3 and make it possible to protect the various constituent elements of the driving device 1, 40 in the event that an excessive torque is applied to the control member 2 and/or to the transmission means 3. Whatever the embodiment adopted, the safety means 60, 80 comprise a static component 61, 81, interdependent with the transmission means 3, a mobile component 62, 82, capable of moving relative to the static component 61, 81 in a direction substantially parallel to the axis of rotation of said transmission means 3, and an elastic restoring means 63, 83 constituted, in the two examples, by a compression spring 64, 84.

The mobile component 62, 82 also possesses an irregular support surface 65, 85, capable of interacting by interlocking with a counter-support surface 66, 86 of complementary shape, made on a support member 67, 87 interdependent with the transmission means 3. The compression spring 64, 84 advantageously makes it possible to maintain each support surface 65, 85 in contact with the associated counter-support surface 66, 86. It should be noted that the concept of irregular surface must be understood in very general terms as a non-planar surface, that is to say a surface comprising asperities and/or inequalities and/or curvatures, etc.

In the first embodiment shown in FIG. 5, the support member 67 is constituted by the pinion 21 of the a conversion means 5. In this specific case, the safety means 60 are consequently positioned within the miniature vehicle 10, in the direct vicinity of said conversion means 5. On the other hand, in the second embodiment according to FIG. 6, the support member 87 is constituted by the control member 2 and is thus not dependent on the miniature vehicle 10, 100 to which the transmission means 3 are attached. This alternative version appears particularly advantageous if the driving device 1, 40 is provided with assembly means 110 (FIGS. 9 and 10) allowing the removal of all that part thereof situated outside the miniature vehicle 10, 100. For reasons of convenience, and also of cost, it is useful to be able to benefit from the possibility of removing said external part of the driving device 1, 40 in order either to reduce the overall bulk of the toy and/or to reuse it with a different miniature vehicle.

The support surface 65 and counter-support surface 66 according to FIG. 5 are substantially identical to their counterparts 85, 86 according to FIG. 6. Each of them extends orthogonally about the axis of rotation of the transmission means 3 so that, once interlocked with the associated surface of complementary shape, the link thus formed can provide ideal resistance to torques of customary intensity without the risk of disengagement, and thus allow the transmission of the rotary movements applied to the control member 2.

In a particularly advantageous manner, the non-planar shape of each support surface 65, 85 or counter-support surface 66, 86 is constituted by a symmetrical and regular relief portion extending radially relative to the point through which the axis of rotation of the transmission means 3 passes. With this specific configuration, it is not necessary to perform a relative rotation of 360° between two complementary surfaces in order to obtain renewed interlocking. The latter is achieved after a brief angular displacement corresponding to the passage from the original position to an immediately consecutive position. The amplitude of this relative displacement depends, of course, on the frequency at which the regular inequalities of the relief portion are arranged.

Thus, as can be partially seen in FIGS. 5 and 6, the symmetrical and regular relief portion of the support surface 65, 85 and counter-support surface 66, 86 is constituted by a succession of radial flutings 68, 88 oriented relative to the point through which the axis of rotation of the transmission means 3 passes. In these examples of embodiment, each of these surfaces 65, 66, 85, 86 additionally possesses an annular shape (FIG. 7) extending to the vicinity of the edge of the component on which said surface 65, 66, 85, 86 is provided. During a succession of disengagement/interlocking operations, the sharp edges of the flutings 68, 88 advantageously generate a sound effect such as to warn the user that the force he is applying to the control member 2 is too great.

FIGS. 5 and 6 likewise make it clear that the safety means 60, 80 are arranged within leaktight housings 150, 151. In a particularly advantageous manner, the conversion means 5, 41 are likewise arranged in leaktight housings, to be protected from soiling.

Figure 7:
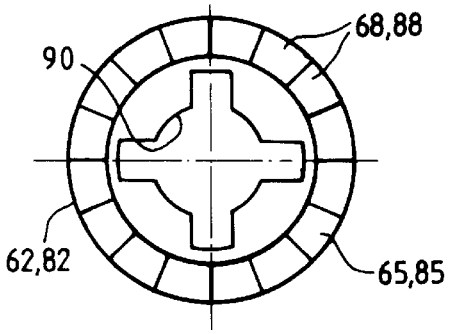
FIGS. 7 and 8 are views, from below and in cross-section respectively, of two components forming part of the safety means according to FIGS. 5 and 6.
Figure 8:
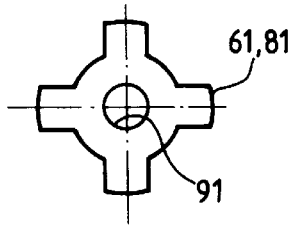

FIG. 7 is a view from below of one of the mobile components 62, 82, shown identically in FIGS. 5 and 6. In particular, the special shape of the support surface 65, 85 described previously can be seen. This illustration likewise highlights the general tubular shape of this component and, in particular, the characteristic cross section of its internal cavity 90 which is completely complementary to the cross section of the static component 61, 81 with which it interacts by sliding. In accordance with the example of embodiment shown in FIG. 8, the cross-section of the static component 61, 81 is of cruciform shape, the central part being tubular in order to allow the passage of the transmission means 3. The bore 91, made in the center of said static component 61, 81, is in the present case completely complementary to the rod 11, 12 on which it is fixed by means of a customary transverse locking member 92, for example of the pin or rivet type.

The complementarity between the outer shape of the static component 61, 81 and the inner shape of the mobile component 62, 82 advantageously permits sliding without play. Furthermore, their respective non-cylindrical cross-sections prevent any rotation in accordance with the axis of the transmission means 3, so that the relative displacement is strictly confined to a simple translatory movement.

Although comprising substantially identical parts, the safety means 60 and 80 function differently because the transmission of the rotary movements, controlled by the control member 2, takes place in accordance with inverse dynamics.

In the first embodiment shown in FIG. 5, the rotation of the control member 2 gives rise to the rotation of the transmission means 3 and, consequently, of the static component 61. As it can only move in axial translation relative to said static component 61, the mobile component 62 is likewise driven to rotate. Provided that the intensity of the transmitted torque does not cause the disengagement of the support surface 65 and the counter-support surface 66, the pinion 21 is in turn caused to rotate, so that the initial movement can be transmitted to the deflection means 4*a*, 4*b* via the conversion means 5.

In the second embodiment according to FIG. 6, the movement actuating the control member 2 is transmitted first to the mobile component 82, which then drives the static component 81 to rotate. As the latter is fixed on the main rod 11, via the locking member 92, the initial rotation is thus communicated to all the transmission means 3.

When the torque becomes excessive, the consequence, by contrast, is identical in both cases and corresponds to a disengagement of the support surface 65, 85 and counter-support surface 66, 86, despite the presence of the compression spring 64, 84.

Once the movement has been transmitted to the conversion means 5, 41, the displacement of the mobile member 7, 44 gives rise to that of the deflection means 4*a*, 4*b*, 42*a*, 42*b*, so that each steered wheel 13 is oriented at a precise angle.

Figure 9:
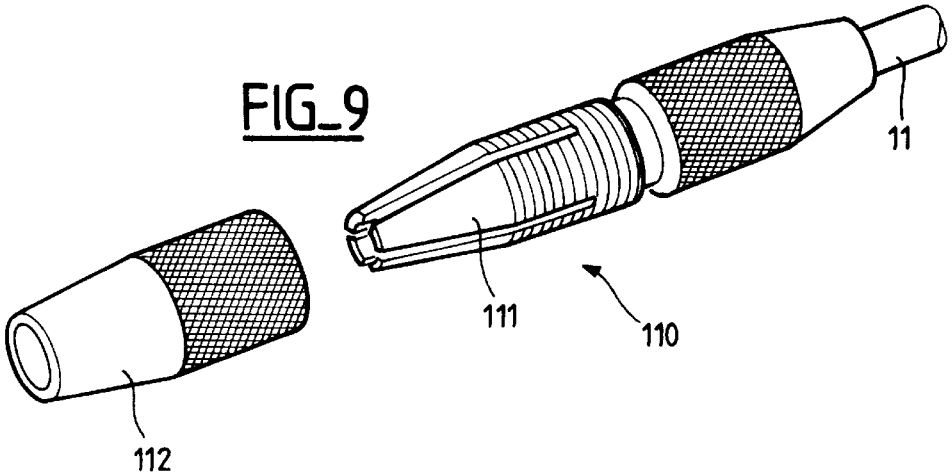
FIGS. 9 and 10 show assembly means according to the invention in perspective and in longitudinal section respectively.
Figure 10:
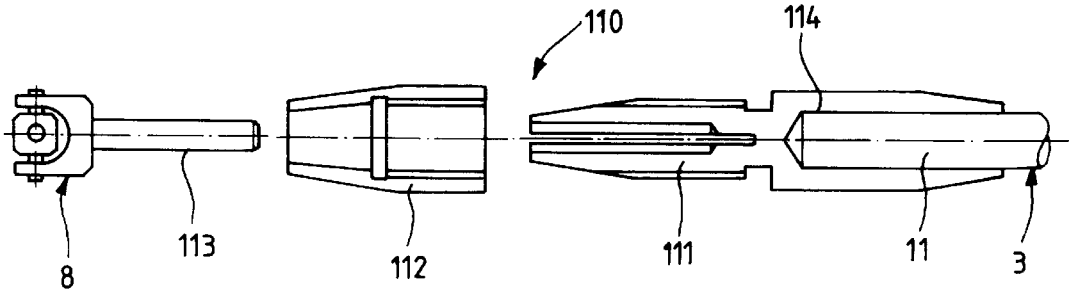

In FIGS. 9 and 10, there may be seen assembly means 110 suitable for removing from the miniature vehicle 10, 100 the control member 2 with, optionally, a part of the transmission means 3. In accordance with the embodiment shown, selected by way of example, the removable installation is achieved by means of a mechanism forming a mandrel, conventionally composed of a gripping head 111 on which a locking ring 112 is screwed. The male part 113, intended to interact with the gripping head ill, is here directly interdependent with the cardan joint 8 in order to allow the removal of substantially all that part of the driving device 1, 40 situated outside the miniature vehicle 10, 100. The gripping head 10 111, for its part, is fixed to the end 114 of the main rod 11 of the transmission means 3.

Figure 11:
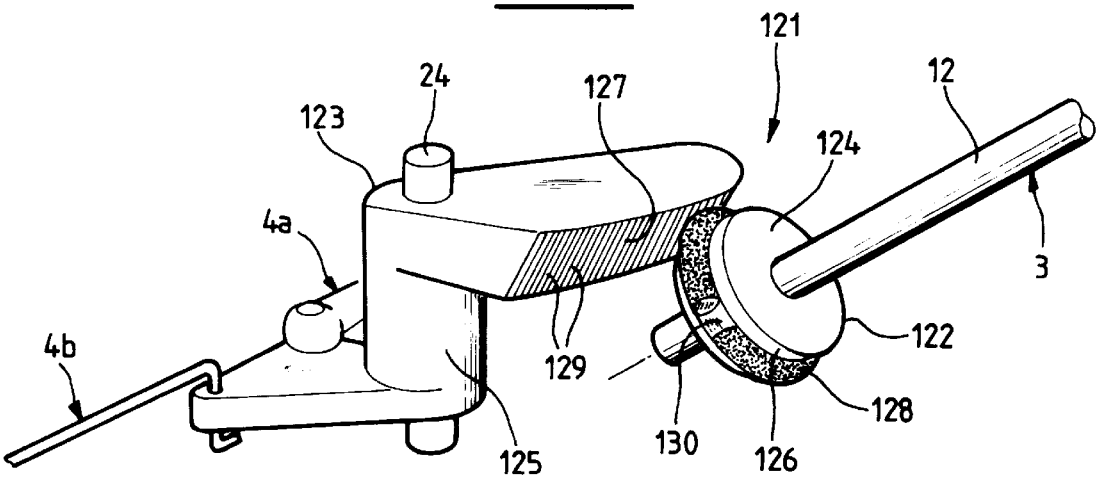
FIGS. 11 and 12 are views, in perspective and from the side respectively, of a driving device according to a first alternative version of a second embodiment of the invention, that is to say an embodiment wherein the conversion means are constituted by two mobile members interacting by adhesive driving.
Figure 12:
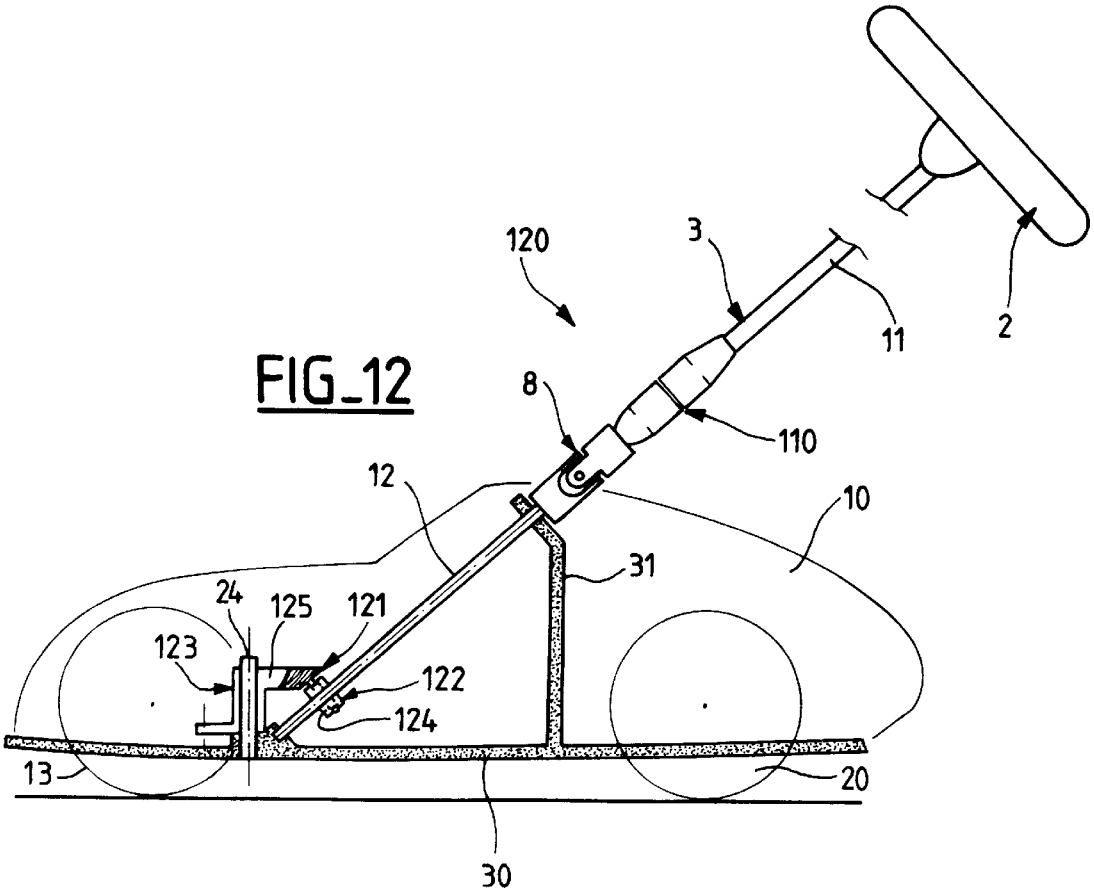
Figure 13:
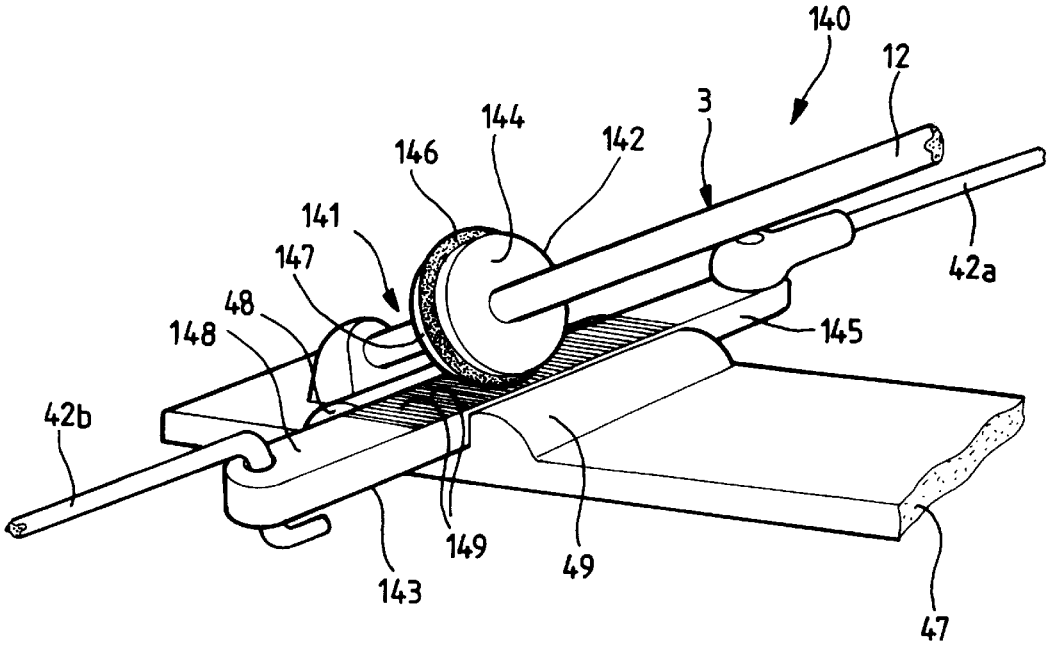
FIG. 13 is a perspective view of a driving device according to a second alternative version of the second embodiment of the invention.

According to FIGS. 11 and 12, the first alternative version of the second embodiment of the invention is characterized by the use of conversion means 121 comprising, in particular, two mobile members 122, 123 interacting in driving by adhesion. In this example of embodiment, the driving device 120 readopts the general architecture of the first alternative version of the first embodiment shown in FIGS. 1 and 2; the principle being to transmit a rotary movement to the deflection means 4*a*, 4*b*, starting with a rotary movement actuating the transmission means 3.

Once again, this version includes a wheel 124 interdependent with the transmission means 3 and a component 125, forming a rudder bar, mounted vertically to pivot relative to the chassis 30, about an axis 24. The basic difference resides in the absence of teeth on the surfaces 126, 127 of the two mobile members 122, 123, which surfaces are intended to come into contact with each other. Since the drive cannot be provided by meshing, it is the adhesion between said contact surfaces 126, 127 which originates the transmission of the movements.

In order for this adhesion to be optimum, the contact surface 126 of the wheel 124 is provided with an adhesive coating 128 while fine striations 129 are provided on the contact surface 127 of the rudder bar 125, so as to form a rough zone. In this particular embodiment of the invention, the adhesive coating 128 is constituted by a toroidal rubber ring seated within a throat 130 made on the contact surface 126 of the wheel 124. The striations 129, for their part, are arranged parallel to the contact surface 127, or along the contact surface 126.

As in the first embodiment, it is likewise possible to envisage a driving device 140 according to a second alternative embodiment concerned exclusively with the conversion means 141. In this case, the mobile members 142, 143 interdependent with the transmission means 3 and with the deflection means 42*a*, 42*b* are constituted, respectively, by a wheel 144 which is mobile in rotation and a rod 145 which is mobile in translation. This configuration is capable of converting any rotary movement actuating the transmission means 3 into a linear movement transmissible to the deflection means 42*a*, 42*b*.

The structure of the wheel 144 is identical to that of the wheel 124 of the first alternative version, in particular as regards the adhesive coating 146 arranged on the contact surface 147. The difference arises simply from the replacement of the rudder bar 125 with the rod 145 whose contact surface 148 is provided with transverse striations 149. The rod 145, moreover, acts as a rack in that it moves linearly to actuate the deflection means 42*a*, 42*b*, and in that said rectilinear movement is transmitted thereto by a member actuated with a rotary movement.

Whatever the alternative version adopted, the second embodiment of the invention has the advantage of being extremely simple and capable of dispensing with safety means 60, 80 in order to preserve the integrity of the various parts constituting the driving device 120, 140 when an excessive torque is applied to the control member 2 and/or to the transmission means 3. This is because, in the event of an excessive force, sliding takes place between the contact surfaces 126, 127, 147, 148 of the associated mobile members 122, 123, 142, 143, that is to say, in the present cases, between the adhesive coating 128, 146 and the striations 129, 149. The skidding which takes place then advantageously serves as a torque limiter, which consequently makes it possible to dispense, if desired, with the safety means 60, 80 contemplated in the context of the first embodiment of the invention.

The invention is, of course, in no way limited by the special features which have been specified in the foregoing or by the details of the particular embodiments selected to illustrate said invention.

In practice, the control member 2 may have a diameter of the order of 23 cm. The part of the driving device 1, 40, 120, 140 situated outside the miniature vehicle 10, 100, about 40 cm in length, may for its part measure about 70 cm.

What is claimed is:

1. A driving device for moving and steering a miniature vehicle with at least one steered wheel comprising:

a control member arranged outside the miniature vehicle that is remote-manipulated by the user;

transmission means transferring inside said miniature vehicle any movement produced on the control member, wherein the control member is mechanically coupled to the transmission means;

means for deflecting the at least one steered wheel which is controlled by said transmission means; and at least two mobile members interacting by driving, wherein one of said mobile members includes a wheel interdependent with the transmission means and the other of the mobile members includes a rudder bar mounted to pivot relative to the miniature vehicle and interdependent with the deflection means.

2. The driving device as claimed in claim 1, wherein the at least two mobile members interact in driving by meshing.

3. The driving device as claimed in claim 2, wherein the rudder bar includes a notched sector meshing with a toothing cut on the wheel forming a pinion.

4. The driving device as claimed in claim 1, wherein the at least two mobile members interact in driving by adhesion.

5. The driving device as claimed in claim 4, wherein the rudder bar includes a sector interacting by adhesion with the wheel.

6. The driving device as claimed in claim 4, wherein at least one of the two mobile members comprises an adhesive coating on the surface intended to come into contact with the associated mobile member.

7. The driving device as claimed in claim 4, wherein at least one of the two mobile members possesses a rough zone on the surface intended to come into contact with the associated mobile member.

8. The driving device as claimed in claim 1, further comprising safety means limiting the torque transmitted by the control member.

9. The driving device as claimed in claim 8, wherein the safety means comprise:

a static component interdependent with the transmission means;

a mobile component moving relative to the static component in a direction substantially parallel to the axis of rotation of said transmission means, said mobile component including an irregular support surface interlocking with a counter-support surface of complementary shape, made on a support member interdependent with the transmission means; and an elastic restoring means holding said support surface and counter-support surface in contact.

10. The driving device as claimed in claim 9, wherein the support member interdependent with the transmission means is constituted by the control member.

11. The driving device as claimed in claim 9, wherein the support member interdependent with the transmission means is constituted by the mobile member.

12. The driving device as claimed in claim 9, wherein the support surface and counter-support surface extend substantially orthogonally to the axis of rotation of the transmission means.

13. The driving device as claimed in claim 9, wherein the support surface and counter-support surface include a symmetrical and regular relief portion extending radially relative to the point through which the axis of rotation of the transmission means passes.

14. The driving device as claimed in claim 9, wherein the support surface and counter-support surface include an annular shape and comprise a plurality of radial flutings oriented relative to the point through which the axis of rotation of the transmission means passes.

15. The driving device as claimed in claim 1, wherein the mobile members are arranged inside a leaktight housing.

16. The driving device as claimed in claim 8, wherein the safety means are arranged inside a leaktight housing.

17. The driving device as claimed in claim 1, wherein the transmission means comprise an articulation mechanism forming a cardan joint.

18. The driving device as claimed in claim 1, wherein the transmission means comprise at least one flexible rod.

19. The driving device as claimed in claim 1, wherein the control member and at least part of the transmission means are removable mounted.

20. The driving device as claimed in claim 19, wherein the assembly means comprise a mechanism forming a mandrel, interdependent with a first portion of the transmission means and interact by gripping with an end of a second portion of said transmission means.

21. A driving device for moving and steering a miniature vehicle with at least one steered wheel comprising:

a control member arranged outside the miniature vehicle that is remote-manipulated by the user;

transmission means transferring inside said miniature vehicle any movement produced on the control member;

means for deflecting the at least one steered wheel which is controlled by said transmission means;

at least two mobile members interacting by driving, wherein one of said mobile members includes a wheel interdependent with the transmission means and the other of the mobile members includes a rudder bar mounted to pivot relative to the miniature vehicle and interdependent with the deflection means; and safety means limiting the torque transmitted by the control member, wherein the safety means include a static component interdependent with the transmission means, a mobile component moving relative to the static component in a direction substantially parallel to the axis of rotation of said transmission means, said mobile component including an irregular support surface interlocking with a counter-support surface of complementary shape, made on a support member interdependent with the transmission means, and an elastic restoring means holding said support surface and counter-support surface in contact.

22. A driving device for moving and steering a miniature vehicle with at least one steered wheel comprising:

a control member arranged outside the miniature vehicle that is remote-manipulated by the user;

transmission means transferring inside said miniature vehicle any movement imparted on the control member;

deflecting means for deflecting the at least one steered wheel controlled by said transmission means;

at least two mobile members interacting by driving, wherein one of said mobile members includes pinion means formed with said deflecting means and the other of said mobile members includes a crossbar means formed with said deflecting means and pivotally mounted around a vertical axis with respect to a chassis of said minature vehicle, the crossbar means including at least two members extending orthogonally with respect to a rotation axis along separate planes and in opposite directions; and reduction means including a toothed circular segment mounted at an end of an upper portion meshing with said pinion means, wherein a lower portion includes a connection point for the crossbar means.

* * * * *